428-151 SR
9/16/86 OR 4,612,228

United States Patent [19]
Kato et al.

[11] Patent Number: 4,612,228
[45] Date of Patent: Sep. 16, 1986

[54] ULTRAFINE FIBER ENTANGLED SHEET

[75] Inventors: Hiroyasu Kato, Minami; Kenkichi Yagi, Otsu, both of Japan

[73] Assignee: Toray Industries, Inc., Tokyo, Japan

[21] Appl. No.: 602,270

[22] Filed: Apr. 23, 1984

Related U.S. Application Data

[63] Continuation-in-part of Ser. No. 479,970, Mar. 29, 1983, Pat. No. 4,476,186.

[30] Foreign Application Priority Data

Mar. 31, 1982 [JP] Japan ..... 57-51119

[51] Int. Cl.[4] ..... D04H 1/58
[52] U.S. Cl. ..... 428/151; 428/288; 428/297; 428/299; 428/300; 428/423.7; 428/904
[58] Field of Search ..... 428/290, 299, 300, 301, 428/156, 171, 423.7, 904, 297, 288, 903, 284, 286, 151

[56] References Cited

U.S. PATENT DOCUMENTS

| | | | |
|---|---|---|---|
| 4,145,468 | 3/1979 | Mizoguchi et al. | 428/299 |
| 4,146,663 | 3/1979 | Ikeda et al. | 428/299 |
| 4,368,227 | 1/1983 | Setsue et al. | 428/253 |

*Primary Examiner*—James J. Bell
*Attorney, Agent, or Firm*—Austin R. Miller

[57] ABSTRACT

An artificial grain leather sheet free of rubber-like elasticity and characterized by excellent softness and strength composed of ultrafine super-entangled synthetic fibers having a denier of less than about 0.5 and a resin. The sheet has a body portion and a grain surface portion wherein the ultrafine fibers are supertangled at a multiplicity of entangling points, with the average distance between entangling points being less than about 200 microns and the fiber density coefficient near the surface being greater than about 30.

21 Claims, 33 Drawing Figures

870X

870 X

ULTRAFINE FIBER ENTANGLED SHEET

This application is a continuation-in-part of application Ser. No. 479,970, filed Mar. 29, 1983 now U.S. Pat. No. 4,476,186.

BACKGROUND OF THE INVENTION

1. Field of the Invention

This invention relates to a novel ultrafine fiber entangled sheet, more particularly, to a novel artificial leather comprising a surface portion of super-entangled fibers having a very high fiber density coefficient and very small amount of a resin. The artificial leather has excellent softness and strength, and is free from rubbery undesirable elasticity. The present invention also relates to a grained artificial leather having a back surface layer which comprises a super-entangled fibers and is preferably substantially free of resin.

2. Description of the Prior Art

Typical examples of conventional non-woven fabrics include (1) non-woven fabric which is produced by needle-punching a web, and (2) non-woven fabric as disclosed in Japanese Patent Publication No. 24699/1969 in which the fiber bundles are entangled with one another while maintaining the bundle form. However, since fabric (1) has a fiber which is relatively thick and has a substantial amount of elastomer, the non-woven fabric is hard and elastic. Hence, the commercial value of this non-woven fabric has been considerably limited. Although fabric (2) is softer than fabric (1), it is easy to break and is still not soft enough. Also, fabric (2) is undesirably elastic and has extremely low shape retention.

U.S. Pat. No. 4,145,468 discloses a fiber sheet comprising a woven or knitted fabric entangled with non-woven fabric by water jet and an artificial leather made thereof. However the artificial leather has rubber-like undesirable elasticity because of a thick surface layer of elastomer and a large amount of impregnated elastomer.

With regard to grained sheets, the grain of conventional synthetic leather consists of a porous or nonporous layer of resin, such as polyurethane elastomer, or of a laminate of a porous layer with a nonporous layer. However, synthetic leather having such a grain has a very undesirable hard rubber-like feel, low crumple resistance, excessively uniform and shallow surface luster, and other disadvantages.

To eliminate these drawbacks, various proposals have been made. These proposals include:

(1) Various fillers, such as fine particles, are added in forming the grain.

(2) Ultrafine fibers are arranged along the surface and combined with a porous material to form the grain. (Japanese Patent Publication No. 40921/1974).

(3) A surface fluff fiber and resin are combined to form the grain.

(4) The surface fibers are melted or dissolved so as to locally bond the fibers and form the grain.

However, method (1) has drawbacks in that the flexibility is reduced and the grain luster of the product is diminished by addition of the fillers. Since the product obtained by method (2) has a grain fiber structure in which the ultrafine fibers are arranged along the surface in bundle form, surface fluffs and peeling develop along the surface of the arrangement of the fiber bundles to cause "loose grain" if the sheet or leather is strongly crumpled or if a shearing stress is repeatedly applied to the sheet. Where the crumpling, or repeated shearing stress continues, cracks eventually occur on the surface. Moreover, fine unevenness occurs on the surface along the bundles of the ultrafine fibers and degrades the surface appearance. The products obtained by methods (3) or (4) have drawbacks in that the surface cracks relatively easily, severely degrading the appearance of the leather, when the sheet is repeatedly bent or a shearing stress is repeatedly applied to the sheet.

SUMMARY OF THE INVENTION

It is an object of the present invention to provide an artificial leather which eliminates the problems encountered with the prior art products described above and which has excellent softness, and high shape retention together with particularly high bending resistance, crumple resistance, shearing fatigue resistance and scratch and scuff resistance.

It is another object of the present invention to provide a grained sheet which has a back surface of good appearance, supple touch, high flexibility and good pilling resistance.

These objects are accomplished by the present invention as described hereinbelow.

The present invention provides an artificial leather comprising a sheet composed of a multiplicity of entangled synthetic fibers having a denier of less than about 0.5, said sheet having a body portion and having a surface portion wherein the fibers are superentangled at a multiplicity of entangling points, the average distance between the entangling points in said surface portion being less than about 200 microns, and the fiber density coefficient, when measured at a surface portion 50 microns deep, being greater than about 30.

Further, the present invention provides an artificial leather having a grained surface and having a back surface, wherein said back surface portion have superentangled fiber layer having a distance between the entangling points of the fibers is less than about 200 microns.

Moreover, the present invention provides an artificial leather which comprises a fiber base and a resin, said fiber base comprising a multiplicity of ultrafine fibers branching from bundles of ultrafine fine fibers or comprising said ultrafine fibers and said bundles of ultrafine fibers throughout its thickness, said ultrafine fibers and bundles of ultrafine fibers being entangled with one another.

BRIEF DESCRIPTION OF THE DRAWINGS

FIG. 1(*b*) is another similar microphotograph, also 435X, according to Example 4 of this specification.

FIG. 2(*b*) is a similar microphotograph corresponding to FIG. 1 (*b*).

FIG. 3(*b*) is a similar view corresponding to FIG. 1(*b*).

FIG. 4(*b*) shows an example of commercially available artificial leather in which resin coating is applied to a raised surface.

FIGS. 5(*a*) and 5(*b*) refer to the present invention (FIGS. 2(*a*) and 2(*b*)) respectively, and FIGS. 5(*c*) and 5(*d*) represent the prior art (FIGS. 4(*a*) and 4(*b*)) respectively.

FIG. 6(*b*) is a similar chart showing resin density coefficients.

DESCRIPTION OF THE PREFERRED EMBODIMENTS

The term "ultrafine fiber bundle" as used herein denotes a fiber bundle in which a plurality of fibers in staple or filament form are arranged in parallel with one another. The fibers may be all of the same type, or a combination of fiber types may be used. The extremely high fiber density at and near the surface of the artificial leather can provide a grained sheet having good hand characteristics such as flexibility and suppleness, smooth surface, high bending resistance, shearing fatigue resistance and scratch and scuff resistance.

It is required that the fiber structure in the surface portion of the grained sheet of the present invention be such that the ultrafine fibers and the fine bundles of the ultrafine fibers be densely entangled with one another and further that the percentage of the total space occupied by the fiber shall be very high. In other words, it is necessary that both the entanglement density and the volumetric fiber density at and just beneath the surface be high. One method of measuring the entanglement density of the fibers is to select a sample and measure the average distance between the fiber entanglement points in the sample. A short average distance between points of entanglement evidences a high density of entanglement.

Figure 7:
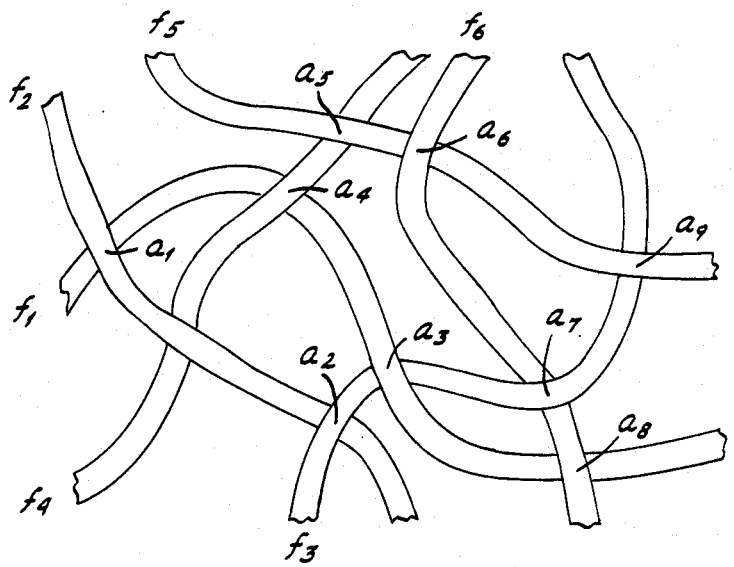
FIG. 7 is a schematic view of entangled fibers at the surface of the leather, illustrating measurement of distance between points of entanglement.

The average distance between the fiber entanglement points is measured in the following manner. FIG. 7 is an enlarged schematic view of the constituent fibers in the grain when viewed from the surface. The fibers are considered to form an entanglement point when an upper fiber passes over and across a lower fiber. It will be assumed that the constituent fibers are $f_1$, $f_2$, $f_3$, . . . , the point at which two fibers $f_1$ and $f_2$ are entangled with each other is $a_1$ and another point at which the upper fiber $f_2$ is entangled with another fiber with the fiber $f_2$ being the lower fiber is $a_2$ (the entanglement point between $f_2$ and $f_3$). Similarly, the entanglement points $a_3$, $a_4$, $a_5$, . . . are determined. The linear distances $a_1a_2$, $a_2a_3$, $a_3a_4$, $a_4a_5$, $a_5a_6$, $a_6a_7$, $a_7a_3$, $a_3a_8$, $a_8a_7$, $a_7a_9$, $a_9a_6$, . . . measured along the surface are the distance between the fiber entangling points and their average is taken.

In the present invention, the fibers of the surface portion must have an average distance between the fiber entangling points of less than about 200 microns as measured by this method. In fiber structures where the average distance between the entangling points is greater than about 200 microns, such as in those fiber structures in which the entanglement of the fibers is effected only by needle punching, only little entanglement of the fibers occurs. When friction, crumpling and shearing stress are repeatedly applied to such fabrics the surface is likely to fluff in an unsightly way or to develop cracks. To eliminate these problems, the average distance between the fiber entangling points must be less than about 200 microns. More favorable results are obtainable when the average distance is less than about 100 microns.

Figure 5A:
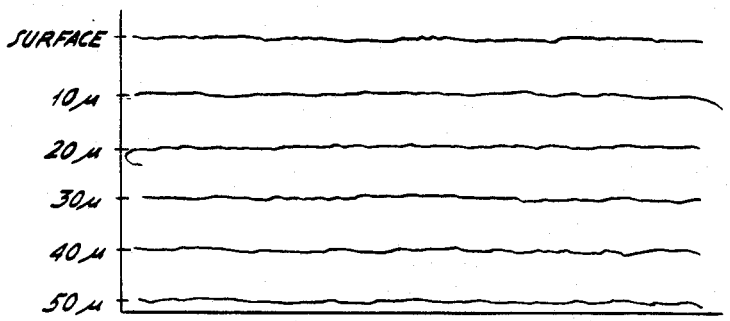
FIG. 5 shows typical measurements of density distributions in the cross-sections of artificial leather.
Figure 5B:
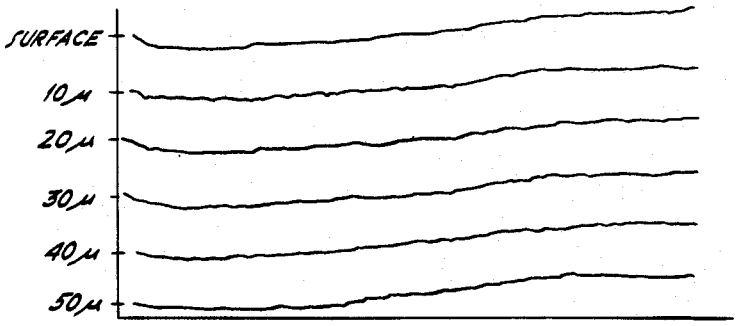
Figure 5C:
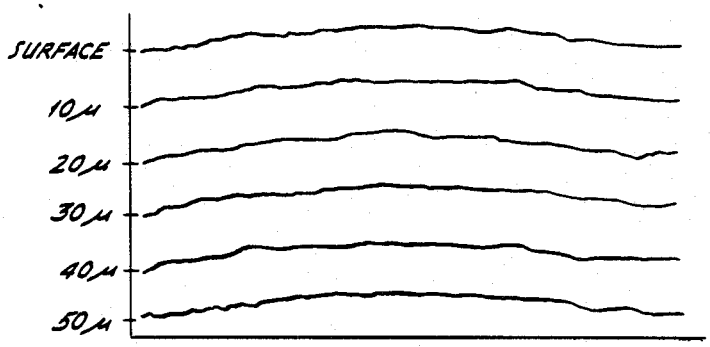
Figure 5D:
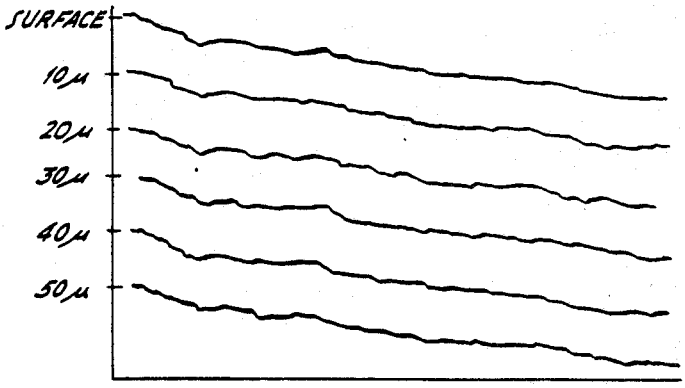
Figure 6A:
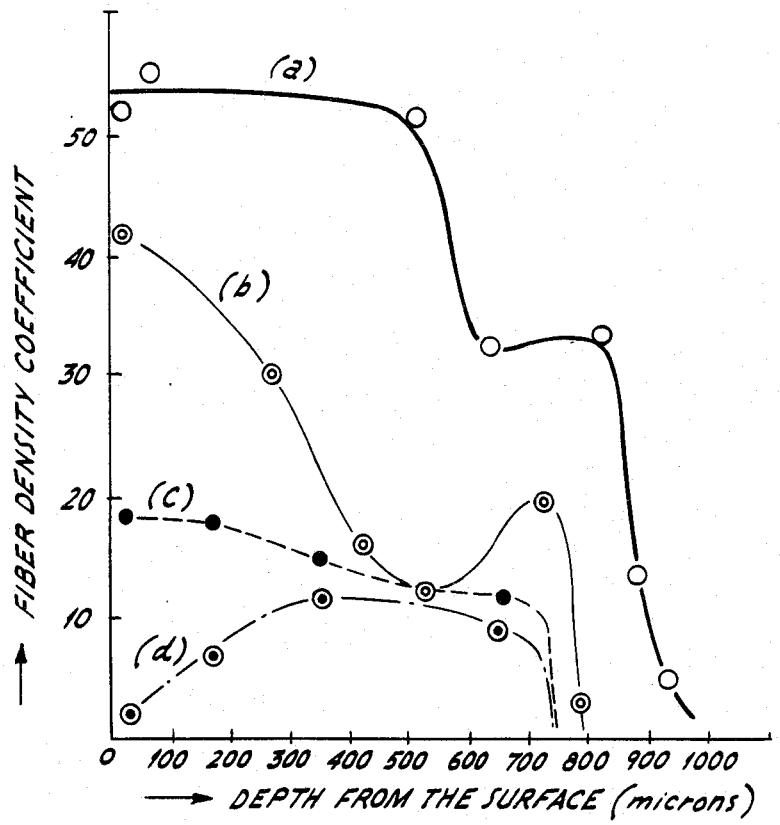
FIG. 6(*a*) shows fiber density distribution curves versus depth from outer surface in a typical artificial leather product of the present invention. Curves (a) and (b) refer to the present invention (FIGS. 1(*a*) and 1(*b*)) respectively, and curves (c) and (d) represent the prior art (FIGS. 4(*a*) and 4(*b*)) respectively.
Figure 6B:
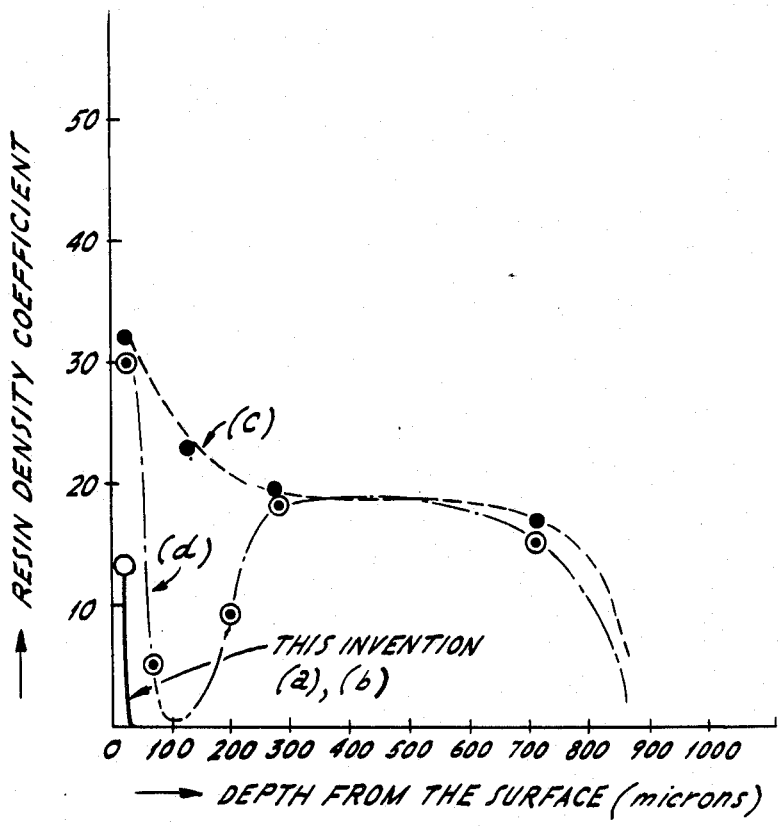

The fiber density coefficient of the fibers may be determined as follows. A scanning electron microphotograph magnified 870 times is observed through transparent sheet having 1 mm graduations in both horizontal and vertical directions, the transparent sheet being placed upon and covering the relevant portion of the microphotograph. All the sections of the transparent sheet (1 mm×1 mm) which cover cut surfaces of the fibers therein may be colored red, and all the sections which cover cut surfaces of any polyurethane or other resin therein may be colored blue. Portions of the microphotograph not representing cut fibers or cut resin are left uncolored and are considered to represent unoccupied space. Thus, the density distribution of the fibers in the cross section under study may be obtained by analysis in a manner such as that shown in FIG. 5(*a*) to 5(*d*). Further, a density distribution curve versus depth from the surface may also be obtained as indicated in FIG. 6(*a*). The density coefficient of the fibers is defined as follows:

Fiber Density Coefficient $=(A/C)\times 100$

Resin Density Coefficient $=(B/C)\times 100$

A represents the number of Sections Colored Red,

B represents the number of Sections Colored Blue, and

C represents the total number of all Sections,

In accordance with the present invention the density coefficient of the fibers in the area at and underneath the surface is extremely high. Namely, the density coefficient of the fibers of a surface portion having a thickness of 50 microns must be more than 30. Preferably, for a portion extending 30 microns in from the surface the fiber density coefficient is more than 30. More preferably, for 20 microns thickness, the fiber density coefficient is more than 30. The fiber density coefficient is often more than 50 for thicknesses (depth) of 50 or 30 or 20 microns. In some cases, it is more than 30 even through a depth 10 microns from the surface (grain) layer.

Because the fiber density coefficient of the fibers of the surface portion so high as to be of an unprecedented order of magnitude the leather surface exhibits extreme toughness against scratching and scuffing, further the surface has excellent softness and free from elasticity. However, a very small amount of resin applied to the surface only is effective to fix the surface structure of the fibers. The resin (such as polyurethane) may comprise the outer 2 to 10 microns of the grain surface layer.

Alternatively the resin may be used together with a minor amount of fiber to protect the surface from fluffing of the fibers.

It is preferable that the fiber density coefficient become lower at the inner portion and at the back surface portion of the artificial leather than at the grain surface. It is more preferable that the resin density coefficient is also low especially at the inner portion and at the back surface portion. The low resin density makes it possible to create an artificial leather having an extremely soft touch, free from elasticity. The super-entangled fiber structure of the present invention makes it possible to reduce the amount of resin drastically for the first time without spoiling the strength and dimensional stability of the artificial leather.

The weight ratio of the fibers based on the total weight of the artificial leather of this invention should be more than 80%, preferably more than 85%, more preferably more than 90%. It is also possible to increase the amount of the fiber more than 95% and, in some cases, more than 98%. In other words, it is even possible to reduce the resin to 2% or less, and make an artificial leather which is almost free from a plastic-like feeling which is too uniform and elastic. Most preferably, only a small amount of resin, for instance less than about 10 $g/m^2$, is applied to the grain surface to fix the dense and superentangled fiber structure at the surface, and substantially no resin is applied to the inner and the back surface portions.

Several typical examples of density coefficients of the fibers and the resin versus depth from the surface of the artificial leather of this invention and the prior art are shown in FIG. 6(*a*), curves (a) to (d).

Traditionally, to protect the surface from scratching and to strengthen the leather and to provide a smooth surface, a thick resin layer which reduces the fiber density at the surface portion has been applied to the surface. Further, to make the leather soft, it is intentionally treated as by buffing to create low density fibers just under the surface non-porous resin layer. Alternatively a porous resin layer has been applied for that purpose. In either case, the density distributions of the fibers at the surface portion of the leather of this invention are drastically different from those of the conventional art.

This invention also provides an artificial leather which has a back surface comprising super-entangled fibers, preferably, ultrafine fibers. The average distance between the entangling points of the fibers at the back surface should be less than about 300 microns, preferably less than about 200 microns, more preferably less than about 150 microns. Also the fiber density coefficient should be quite high, namely not less than 10, preferably not less than 15. Due to processing steps such as dyeing some of the fine fibers are partially freed from entanglement and extend from the back surface, giving a soft feel and high resistance to pilling and fluffing. We have found that the super-entangled fiber surface, especially of ultrafine fibers, has excellent resistance against pilling and fluffing during the dyeing process and during ordinary use, even when substantially no resin or a very small amount of resin has been applied. The back surface has a very soft touch and a slightly fluffed appearance, and is free from elasticity.

Conventionally, the back surface of the leather has been finished by impregnation with a large amount of a resin followed or not followed by buffing or slicing, to prevent unequal fluffing. This not only spoils the appearance of the back surface but also weakens the leather. If the density of the resin at the back surface becomes high by impregnation, the artificial leather becomes hard and susceptible to be deeply lined when bent, which spoils the feel and appearance of the leather. On the other hand, if the fiber density coefficient at the back surface is too low, the back surface lacks in density and is apt to fluff or exhibit uneven entanglement or pilling during use. The fiber density coefficient at a back surface portion of 200 microns thickness should be greater than 10, preferably 15. In determining the thickness, any portion beyond the portion whose density coefficient of fiber and resin is less than about 5 should be neglected. The softness at the back surface is greatly enhanced by crumpling, such as by liquor flow dyeing (jet dyeing) a super-entangled fiber sheet formed by water jets and impregnated with substantially no resin or a very small amount of resin. These crumpling steps reduce the fiber density at the back surface, but the super-entanglement prevents the surface from being loosened or fluffed excessively.

The entangled non-woven fabric for use in the present invention preferably has a fiber structure including a portion (A) in which the bundles of ultrafine fibers or the bundles of ultrafine fibers and branched fibers are three-dimensionally entangled with one another and a portion (B) in which ultrafine fibers or fine bundles of ultrafine fibers branched from the ultrafine fiber bundles of portion (A), the fine bundles of ultrafine fibers being thinner than the fiber bundles of portion (A), are super-entangled with one another, and portion (A) and (B) are nonuniformly distributed in the direction of fabric thickness. The fiber that forms the entangled non-woven fabric of the present invention has a fiber structure such that one ultrafine fiber is one of fibers constituting a bundle at some portions of the bundle and branches from the bundle at the other portions of the bundle. Therefore, the ultrafine fiber bundles and the fibers branched from said bundles are not independent.

Figure 1A:
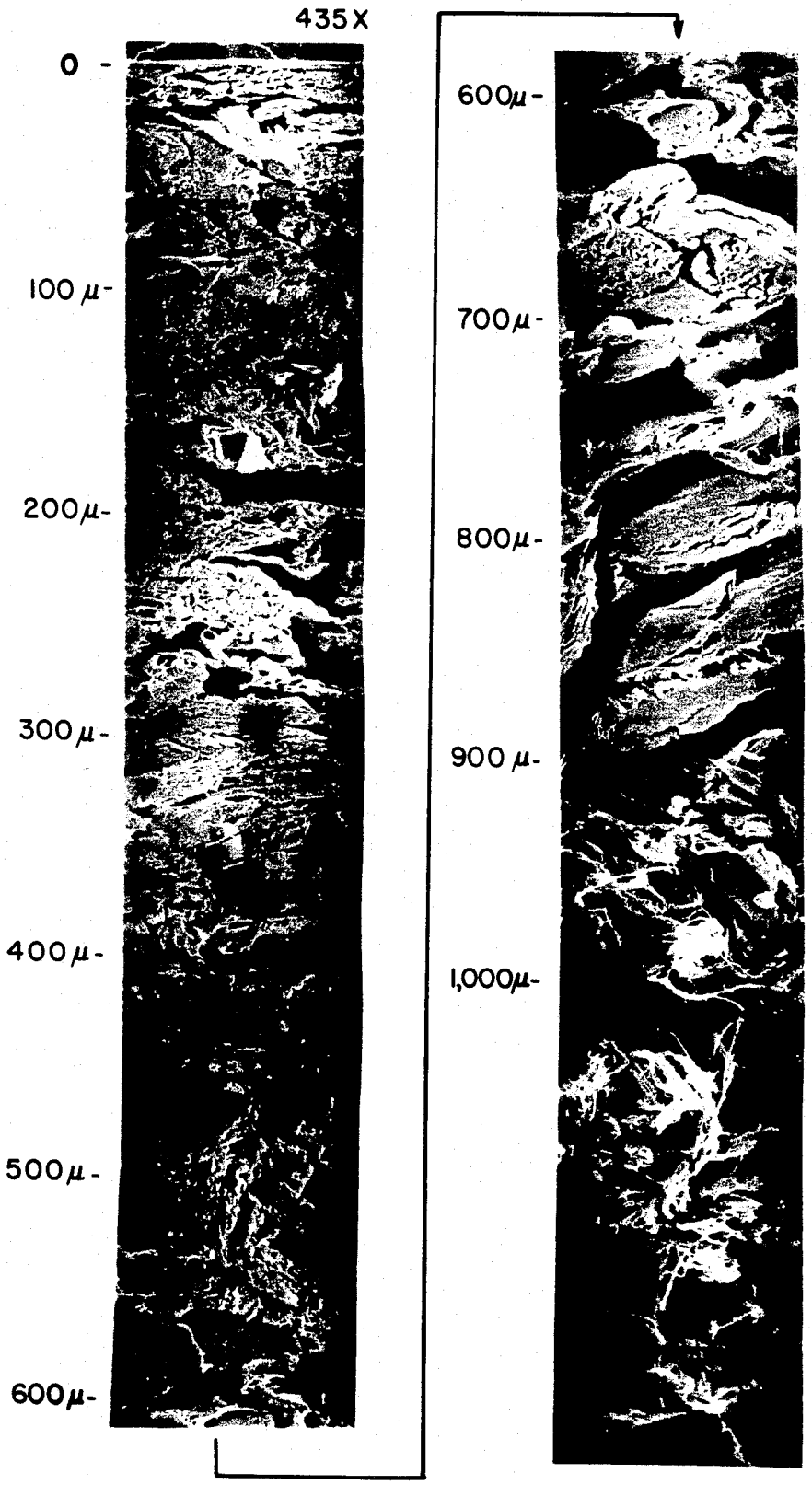
FIG. 1(*a*) is a microphotograph (435X) of a blade cut section of a typical artificial leather according to the present invention. The figure has been cut into two parts because of its size; The grain surface appears at the upper left and the back surface at the lower right. The lower left and the upper right join together and represent the center of the sample. This sample corresponds to Example 2 of this specification.
Figure 1B:
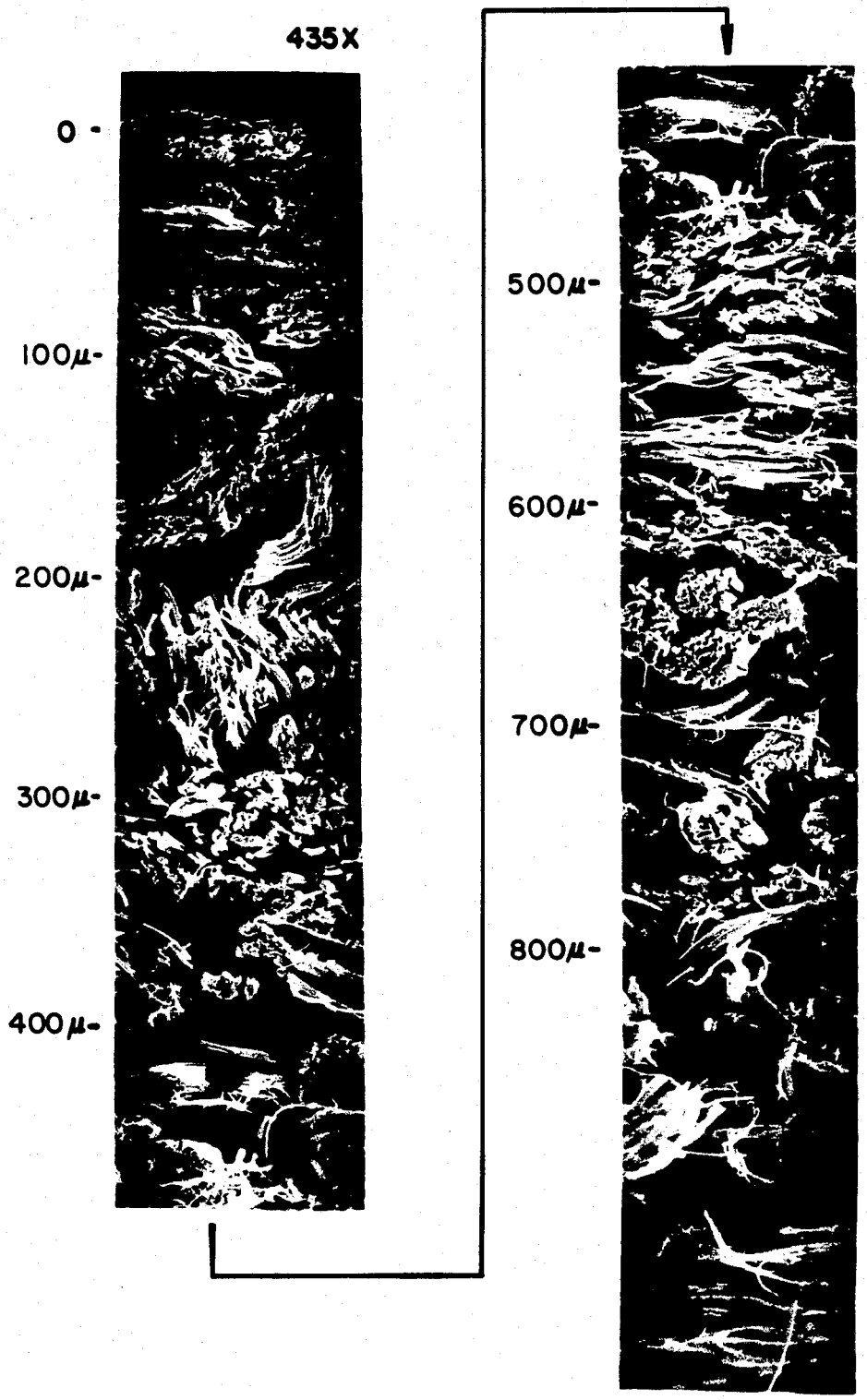
Figure 2A:
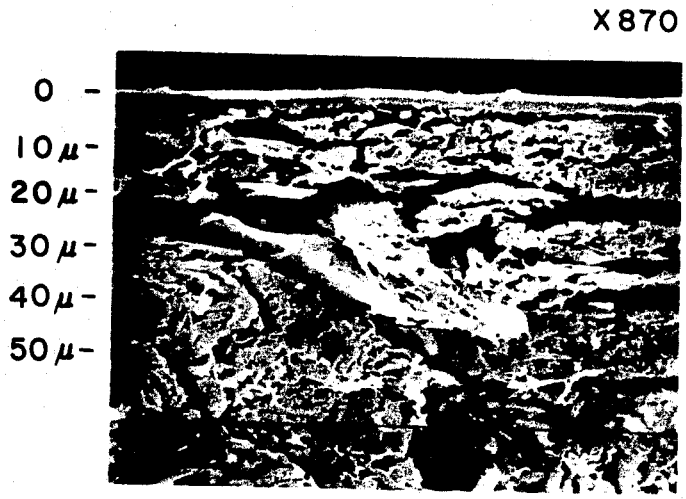
FIG. 2(*a*) is a microphotograph (870X) of a portion of the artificial leather of FIG. 1(*a*), showing particularly the structure extending to and somewhat beyond the 50 micron depth as measured from the grain surface.
Figure 2B:
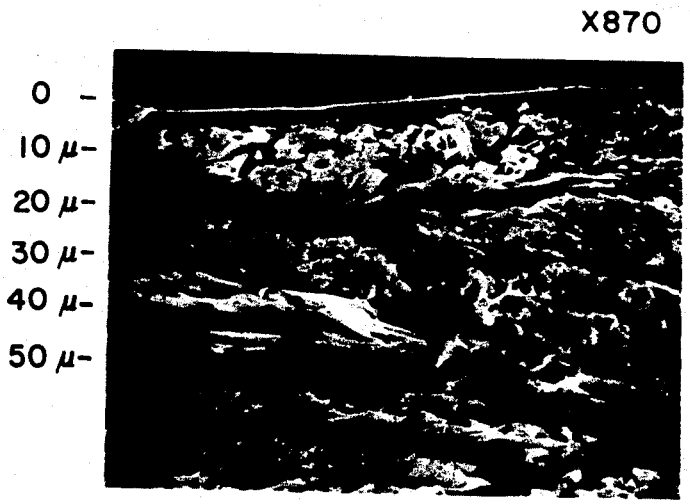
Figure 3A:
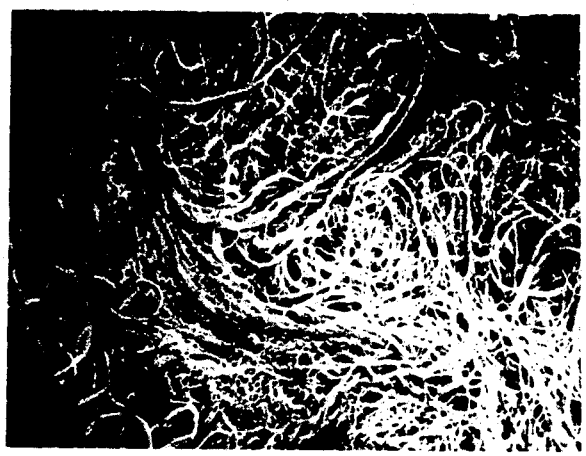
FIG. 3(*a*) is a surface view (870X) of the leather of FIG. 1(*a*) without any coating of polyurethane.
Figure 3B:
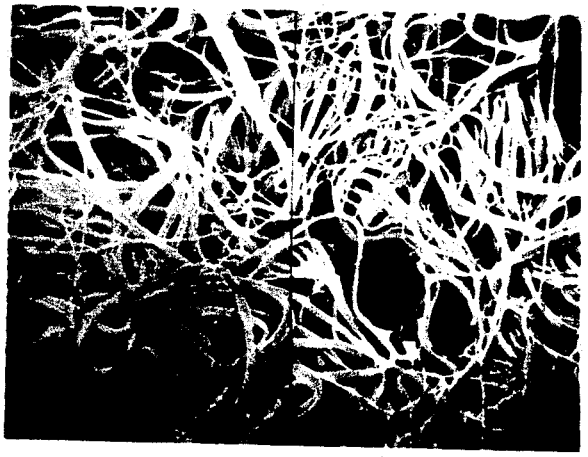
Figure 4A:
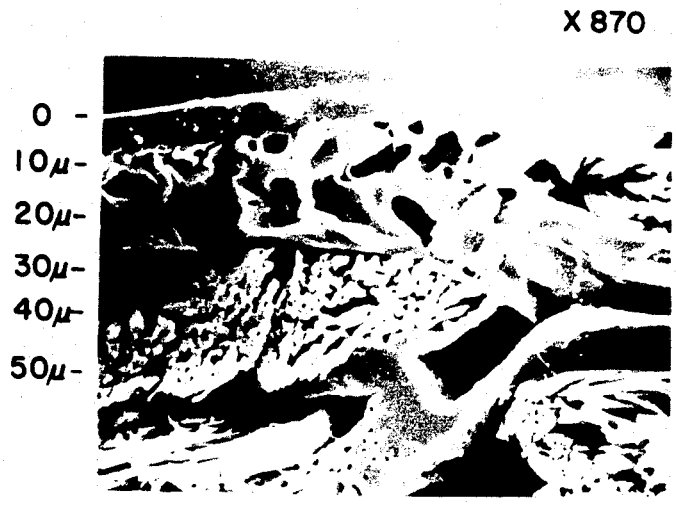
FIG. 4(*a*) is a microphotograph (870X) showing a surface portion of a prior art artificial leather of Comparative Example 1.
Figure 4B:
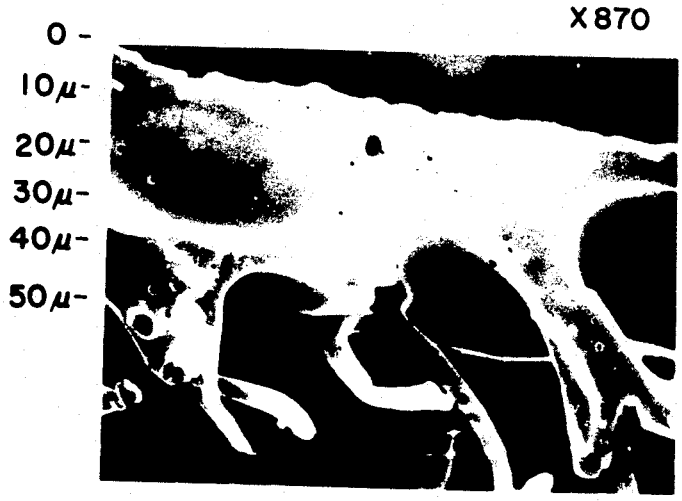

The objects of the present invention can be accomplished effectively when portions (A) and (B) are nonuniformly distributed in the direction of the thickness of the fabric. It is particularly preferred that portion (B) be nonuniformly distributed along the surface portion. Portion (B) strenthens the leather and provides a smooth surface and portion (A) provides softness. Such a non-woven fabric has less fraying of the surface fibers and resists pilling. If the non-woven fabric has a fiber structure in which the ultrafine fibers constituting portions (A) and (B) are substantially continuous and the degree of branching of the fibers in the proximity of the boundary between the portions changes continuously, the non-woven fabric is flexible and supple and portions (A) and (B) do not peel from one another. FIGS. 1-3 show embodiments of the entangled non-woven fabric in accordance with the present invention.

Resins which may be used for the grained sheet are synthetic or natural polymer resins such as polyamide, polyester, polyvinyl chloride, polyacrylate copolymers, polyurethane, neoprene, styrene butadiene copolymers, acrylonitrile/butadiene copolymers, polyamino acids, polyamino acid/polyurethane copolymers, silicone resins and the like. Mixtures of two or more resins may also be used. If necessary, additives such as plasticizers, fillers, stabilizers, pigments, dyes, cross-linking agents, and the like may be further added. Polyurethane elastomeric resin, either alone or mixed with other resins or additives, is preferably used because it provides a grain having particularly good hand characteristics such as flexibility and suppleness, good touch and high bending resistance.

The structure of the resin deposited within the grained sheet is dependent on the intended application. Where flexibility and soft touch are required such as in apparel, preferred structures are those in which the resin is applied in a progressively increasing amount toward the surface of the grained sheet. The quantity of resin deposited is the greatest in an extremely thin layer on the outermost surface of the grained sheet with little or no resin at other portions. The resin at the surface portion is non-porous, whereas the portion below the surface portion is porous. Where high scratch and scuff resistance are particularly required, a preferred fiber structure is one where the resin is packed substantially fully into the gap portions of the grain without leaving any gaps intact. The grained sheet in accordance with the present invention includes, of course, one in which the outermost surface of the grain consists of a thin resin layer of up to about 20 microns of a resin such as a polyurethane elastomer which is integrated with the other portions.

As the ultrafine fibers to be used in the present invention, there may be mentioned those which are produced by various direct methods, such as super-draw spinning, melt-blow spinning using a gas stream, and so forth. In accordance with these methods, however, spinning becomes unstable and difficult if the fiber size becomes too fine. For these reasons, it is preferred to employ the following types of fibers which are formable into ultrafine fibers and to modify them into ultrafine fibers at a suitable stage of the production process. Examples of such ultrafine fiber formable fibers include those having a chrysanthemum-like cross-section in which one component is radially interposed between other components, multi-layered bicomponent type fibers, multi-layered bicomponent type fibers having a doughnut-like cross-section, mixed spun fibers obtained by mixing and spinning at least two components, islands-in-sea type fibers which have a fiber structure in which a plurality of ultrafine fibers that are continuous in the direction of the fiber axis are arranged and aggregated and are bounded together by other components to form a fiber, specific islands-in-sea fibers which have a fiber structure in which a plurality of islands-in-island are arranged and aggregated and are bonded together by other components to form an island and a plurality of these islands are arranged and aggregated and are bonded together by other components to form a fiber, and so forth. Two or more of these fibers may be mixed or combined It is preferable to use ultrafine fiber formable fibers having a fiber structure in which a plurality of cores are at least partially bonded by other binding components, because ultrafine fibers are easily formed by removing the binding components by applying physical or chemical action.

FIGS. 8(*a*) to 8(*r*) show examples of ultrafine fiber formable fibers which may be used to obtain the ultrafine fibers. Reference numerals 1 and 1' represent ultrafine fibers and reference numerals 2 and 2' represent binding components. The ultrafine fibers may be composite fibers consisting of similar polymer materials in kind or different polymer materials in kind. Other types of fibers which may be used include crimped fibers, modified cross-section fibers, hollow fibers, multi-hollow fibers and the like. Further, ultrafine fibers of different kinds may be mixed.

The size of the ultrafine fibers in accordance with the present invention must not be greater than about 0.5 denier. If the denier is greater than 0.5, the stiffness of the fibers is so great that the resulting non-woven fabric has low flexibility and it is difficult to densely entangle the fibers.

The ultrafine fibers in the grain of the grained sheet of the present invention are preferably less than about about 0.2 denier. If the fibers are greater than 0.2 denier, the fiber stiffness is so great that the grain loses flexibility, the surface develops unsightly creases and cracks, surface unevenness is likely to occur upon crumpling of the sheet and it is difficult to form a dense and flexible grain. Only with ultrafine fibers having a size less than about about 0.2 denier, more preferably, less than about 0.05 denier, more preferably less than about 0.01 denier, can a leather-like sheet be obtained which has a grain fiber structure in which the fibers are densely entangled with one another, which has excellent smoothness, which is soft and which is resistant to development of cracks. Multiple-component ultrafine fiber formable fibers, which provide fiber bundles principally comprised of ultrafine fibers having a denier less than about 0.2, preferably less than about 0.05 denier, more preferably less than about 0.01 denier and in which at least one component may be dissolved and removed, are preferably employed. Such fibers can provide a grained sheet having particularly excellent hand characteristics, such as flexibility and suppleness, and a smooth surface. Those fibers which have a specific fiber structure in which a plurality of extra-ultrafine fibers are arranged and aggregated and are bonded together by other components to form one ultrafine fiber (primary bundle) and a plurality of these ultrafine fibers are arranged and aggregated and are bonded together by other components to form one fiber (secondary bundle) can be fibrillated extremely finely and entangled densely when they are subjected to high speed fluid jet streams. Hence, such fibers provide a grained sheet having extremely soft and excellent touch.

The ultrafine fibers of the present invention consist of polymer material having fiber formability. Examples of the polymer material include polyamides, such as nylon 6, nylon 66, nylon 12, copolymerized nylon, and the like; polyesters, such as polyethylene terephthalate, polybutylene terephthalate, copolymerized polyethylene terephthalate, copolymerized polybutylene terephthalate, and the like; polyolefins, such as polyethylene, polypropylene, and the like; polyurethane; polyacrylonitrile; vinyl polymers; and so forth. Examples of the binding component of the ultrafine fiber formable fibers, or the component which is to be dissolved for removal, include polystyrene, polyethylene, polypropylene, polyamide, polyurethane, copolymerized polyethylene terephthalate that can be easily dissolved in an alkaline solution, polyvinyl alcohol, copolymerized polyvinyl alcohol, styrene/acrylonitrile copolymers, copolymers of styrene with higher alcohol esters of acrylic acid and/or with higher alcohol esters of methacrylic acid, and the like.

From the aspect of fiber spinnability, as well as dissolvability for removal of the binding component, however, polystyrene, styrene/acrylonitrile copolymers, and copolymers of styrene with higher alcohol esters of acrylic acid and/or with higher alcohol esters of methacrylic acid are preferably used. The copolymers of styrene with higher alcohol esters of acrylic acid and/or with higher alcohol esters of methacrylic acid are further preferably used because during drawing they provide a higher draw ratio and fibers having higher strength.

In order to easily fibrillate the ultrafine fiber formable fibers it is preferred to mix some amount of heterogeneous substance to the binding component before spinning. Such heterogeneous substance makes it easy to break or remove the binding component by treating with high speed fluid jet streams. Thus the ultrafine fiber formable fibers are fibrillated into ultrafine fibers or fine bundles of ultrafine fibers and densely entangled. Examples of the heterogeneous substances include polyalkyleneetherglycols, such as polyethyleneetherglycol, polypropyleneetherglycol, polytetramethyleneetherglycol and the like; substituted polyalkyleneetherglycols such as methoxypolyethyleneetherglycol and the like; block or random copolymers such as block copolymer of ethyleneoxide and propyleneoxide, random copolymer of ethyleneoxide and propyleneoxide, and the like; alkyleneoxide additives of alcohols, acids or esters, such as ethyleneoxide additive of nonylphenol and the like; block copolymers of polyalkyleneetherglycols and other polymers, such as block polyetherester of polyethyleneetherglycol and various polyesters, block polyetheramide of polyethyleneetherglycol and various polyamides; polymers mentioned above as the binding component in combination with different polymer as the binding component; fine particles of inorganic compounds such as calcium carbonate, talc, silica, colloidal silica, clay, titanium oxide, carbon black and the like; mixtures thereof and so forth.

In view of spinnability and effect of fibrillation, organic polymers, especially polyalkyleneetherglycols are preferable. Among these, polyethyleneetherglycol is most effective for fibrillation and dense entanglement. Presence of a certain amount of polyethyleneetherglycol helps breaking of a binding component while treating with the high speed fluid jet streams and makes it possible to remove the binding component without dissolving out by a solvent.

A preferable molecular weight range of the polyalkyleneetherglycol is 5,000 to 600,000, especially, 5,000 to 100,000 in view of its melt viscosity.

The preferred amount of heterogeneous substance varies according to intended use. In case of polyalkyleneetherglycol, 0.5 to 30 wt %, based on the total amount of binding component, is preferable. 2 to 20 wt % is most preferable. If the amount is under 0.5 wt %, the fibrillation effect is inferior and if the amount is over 30 wt %, fiber spinnability becomes worse.

There is no limitation, in particular, to the size of the ultrafine fiber formable fibers but the preferred size range is from about 0.5 to 10 denier in view of spinning stability and ease of sheet formation.

The method of producing the entangled non-woven fabric in accordance with the present invention comprises, for example, forming a web by use of fiber bundles which are obtained by bundling ultrafine fibers obtained in the manner described above and temporarily treating them with a binding component to retain the fibers in bundle form, or by use of filaments or staple fibers of ultrafine fiber formable fibers, then optionally needle-punching the resulting web to form an entangled structure and thereafter removing the binding component using a solvent which can dissolve only the binding component. Thereafter, the resulting entangled structure is treated with high speed fluid jet streams so as to branch the ultrafine fibers and the fine bundles of ultrafine fibers from the ultrafine fiber bundles and to simultaneously entangle the branching ultrafine fibers and the fine bundles of ultrafine fibers. A step of applying a paste, such as polyvinyl alcohol, to temporarily fix the non-woven fabric as a whole after the entangled structure is formed by needle-punching, and removing the paste after dissolution and removal of the binding component or simultaneously effecting the high speed fluid jet streams treatment with the removal of the paste, so as to prevent the collapse of the shape of the non-woven fabric at the time of dissolution and removal of the binding component may optionally be used in the process. The treatment with the high speed fluid jet streams may be effected before the binding component is removed.

In some cases, branching of the fibers by treatment with the high speed fluid jet streams is not sufficiently effected because the ultrafine fibers are bonded together by the binding component. In such cases, branching can be accomplished extremely effectively by use of a nozzle which has holes of large diameter or by the following method. A polymer, such as polyethylene glycol, is added to the binding component for the ultrafine fibers or, alternatively a substance that can degrade or plasticize the binding component is applied to the fiber sheet before the treatment with the high speed fluid jet streams.

Examples of a substance that can degrade or plasticize the binding component include degrading agents, solvents, plasticizers and surfactants for such a binding component. Any substance can be used which can cause cracks in the binding components, can change the binding component into a powder, can plasticize or degrade it and can thus reduce the collapse resistance of the binding component at the time of the treatment with the high speed fluid jet streams. For such surfactants, some esters of polyalkyleneetherglycols and carboxylic acids are useful. As polyalkyleneetherglycol, polyethyleneetherglycol, polypropyleneetherglycol, polytetramethyleneetherglycol and copolymer thereof are preferably used. As carboxylic acid, propionic acid, butyric acid, caproic acid, caprylic acid, lauric acid, myristic acid, palmitic acid, stearic acid, and the like, are preferably used.

In order to obtain the structure of the entangled non-woven fabric of the present invention, the apparent density of the non-woven fabric before the treatment with the high speed fluid jet streams is preferably from about 0.1 to 0.6 g/cm$^3$. If the apparent density is below about 0.1 g/cm$^3$, the fibers move easily and those pushed by the fluid jet streams penetrate through the non-woven fabric and intrude into the metal net on which the non-woven fabric is placed, so that severe unevenness appears on the surface of the non-woven fabric. If the apparent density is above about 0.6 g/cm$^3$, the fluid jet streams are reflected on the surface of the non-woven fabric and entanglement is not sufficiently accomplished.

The term "fluid" herein used denotes liquid or a gas and, in some particular cases, may contain an extremely fine solid. Water is most desirable from the aspects of ease in handling, cost and the quantity of fluid collision energy. Depending upon the intended application, various solutions of organic solvents capable of dissolving the binding component, and aqueous solutions of alkali, such as sodium hydroxide, for example, or an aqueous solution of an acid may also be used. These fluids are pressurized and are jetted from orifices having a small aperture diameter or from slits having a small gap in the form of a high speed columnar streams or curtain-like streams.

There is no limitation, in particular, to the shape of the jet nozzle main body, but a transverse nozzle having a number of orifices having a diameter of about 0.01 to 0.5 mm that are aligned with narrow gaps between, in a line or in a plurality of lines can be conveniently used to obtain a fiber sheet having less surface unevenness and uniform properties.

The gap between the adjacent orifices is preferably from about 0.2 to 5 mm in terms of the distance between the centers of these orifices. If the gap is smaller than about 0.2 mm, machining of the orifices becomes difficult and the high speed fluid jet streams are likely to come into contact with streams from adjacent orifices. If the gap is greater than about 5 mm, the surface treatment of the fiber sheet must be carried out many times.

The pressure applied to the fluid varies with the properties of the non-woven fabric and can be freely selected within the range of about 5 to 300 kg/cm$^2$. The high speed fluid jet streams may contact the fiber sheet several times. The pressure for each jet may be varied or the nozzle or non-woven fabric may be oscillated during jetting to optimize fabric properties.

The binding component used for bundling and temporarily bonding the ultrafine fibers is preferably one which can be easily removed by water for industrial economy. Examples of such components are starch, polyvinyl alcohol, methylcellulose, carboxymethylcellulose and the like. Synthetic and natural pastes and adhesives that can be dissolved by solvents can also be used. Examples of such pastes and adhesives are vinyl type latex, polybutadiene type adhesives, polyurethane type adhesives, polyester type adhesives, polyamide type adhesives, and so forth.

In the production of the entangled non-woven fabric in accordance with the present invention, it is not necessary to use wholly ultrafine fibers and a combined use of other fibers may be permitted in so far as it does not diverge from the object of the present invention. It is also possible to incorporate resin binder as well.

The grained sheet in accordance with the present invention may be produced by the following method. The ultrafine fiber formable fibers are first produced by use of a spinning machine such as one disclosed in Japanese Patent Publication No. 18369/1969, for example, and are then converted into staple fiber, and the resulting staple fibers are passed through a card and a cross lapper to form a web. The web is needle-punched to entangle the ultrafine fiber formable fibers and to form a fiber sheet. Alternatively, after the ultrafine fiber formable fibers are spun, they are subsequently stretched and are randomly placed on a metal net. The resulting web is needle-punched in the same way as above to obtain the fiber sheet. Still alternatively, the ultrafine fiber formable fibers are placed on a non-woven fabric, woven fabric or knitted fabric consisting of ordinary fibers or another kind of ultrafine fiber formable fibers and are inseparably entangled to form a fiber sheet. The fiber sheet thus obtained is treated with a high speed fluid jet streams to branch the ultrafine fiber formable fibers into ultrafine fibers to fine bundles of ultrafine fibers and to simultaneously entangle the fibers and their bundles. The treating method used for the production of the entangled non-woven fabric of the present invention described above can also be used for this high speed fluid jet stream treatment. The non-woven fabric of the present invention described hereinabove can also be preferably used for producing the grained sheet of the present invention.

If the ultrafine fiber formable fibers used are of the type which can be modified to ultrafine fiber bundles when part of the components are dissolved and removed, the dissolving and removing step is thereafter applied depending on the intended application. If necessary, the sheet is wet-coagulated or dry-coagulated by impregnating the sheet with a solution or dispersion of a polyurethane elastomer or the like. In this instance, part of the fiber components may be dissolved and removed before the high speed fluid jet stream treatment. Since the ultrafine fiber formable fibers of the sheet are modified into bundles of ultrafine fibers as part of the components are dissolved and removed, the fibers can be highly branched and entangled easily by a low fluid pressure. The high speed fluid jet stream treatment may be effected both before and after the dissolving and removing treatment of the component.

It is further possible to interpose the step of applying the resin between the high speed fluid jet streams treatment and the dissolving and removing step of the component. In this case, it is necessary that the resin should not be dissolved by the solvent used for dissolving and removing the component. Since the component is thus removed, the gaps are defined between the ultrafine fiber bundles and the resin of the resulting fiber sheet and promote freedom of mutual movement of the fibers. Hence, this is a preferred method for providing the resulting sheet with excellent hand characteristics, such as flexibility and suppleness.

On the other hand, application of the high speed fluid jet stream treatment after the application of the resin is not preferable because, if the deposition quantity of the resin is too great, the fibers are restricted by the resin and consequently, branching and entanglement of the fibers and their bundles can not readily be effected. Thereafter, the solution or dispersion of the aforementioned grain resin is applied to the layer of the fiber sheet in which ultrafine fibers to fine bundles of ultrafine fibers are entangled with one another, by suitable methods such as reverse roll coating, gravure coating, knife coating, slit coating, spray coating and the like, is then wet-coagulated or dry-coagulated, is put on the surface of a roller or the surface of the plane sheet and is thereafter pressed and, if necessary, heated so as to integrate the fibers with the resin and to simultaneously flatten the surface.

In this case, it is preferred to make the surface of the fiber sheet flat by heat-pressing the fiber sheet before the application of the grain resin. The use of an embossing roller or a sheet having a grain pattern is preferred because integration, flattening and application of the grain pattern can be simultaneously conducted. If necessary, depending on the final application, coating with a finishing agent, dyeing, crumpling and the like may be carried out.

In using the grained sheet of the present invention for apparel, the following method is preferably employed if flexibility and soft touch are particularly necessary. A substance that can degrade or plasticize the binding component of the ultrafine fiber formable fibers is applied to the fiber sheet consisting of such ultrafine fiber formable fibers and high speed fluid jet stream treatment is then carried out. The resulting fiber sheet is heat-pressed so as to make the surface to which the high speed fluid jet stream treatment is applied smooth. Next, this surface is coated with a resin solution of a polyurethane elastomer or the like and is solidified in such a manner that part of the resin penetrates into the sheet and resin remains as a thin layer on the sheet surface. A grain pattern is then applied using an embossing roller on the sheet surface, if necessary, and after the binding component is dissolved and removed, finishing treatments, such as dyeing, application of softening agents, crumpling and the like are carried out.

The grained sheet in accordance with the present invention has excellent hand characteristics such as flexibility and suppleness, smooth surface touch, high bending resistance, high shearing fatigue resistance and high scratch and scuff resistance. For these properties, the grained sheet can be suitably used as grained synthetic leather for apparel, shoe uppers, handbags, bags, belts, gloves, surface leather of balls and the like.

The following examples are intended to further clarify the present invention but are in no way limitative. In the examples which follow, the terms "part or parts" and "%" refer to the "part or parts by weight" and "% by weight" unless otherwise stipulated. The value of the average distance of the fiber entangling points is a mean value of 100 measured values.

The bending resistance, shearing fatigue resistance and scratch and scuff resistance of the grained sheet were measured according to the following methods:

(1) Bending Resistance

The degree of the damage of the grained surface was judged in accordance with JIS (Japanese Industrial Standard) K 6545-1970.

(2) Shearing fatigue resistance

A 3 cm-wide rectangular testpiece was held by clamps having a clamp gap of 2 cm and stretched by moving one of the clamps parallel to another clamp until a stretch ratio of 25% was reached, then the clamp was moved to the opposite position. This procedure was repeated at a speed of 250 times/min. The degree of damage to the grained surface after 10,000 cycles was judged in accordance with the judging standard described in item (1) above.

(3) Scratch and scuff resistance

The grained surface was scratched by a needle of 1 mm diameter with 500 g load using a Clemens scratch tester. The degree of scratch and scuff resistance was judged by the number of scratches required to develop visible damage on the grained surface.

EXAMPLE 1

4.0 denier, 51 mm long staple fibers of specific islands-in-sea type fibers (16 islands), and having a composition consisting of 80% of islands and 20% of sea, and further, each island consists of 50% of a large number of islands-in-island (I-I-I) and 50% of sea-in-island (S-I-I) were prepared. Said sea and S-I-I component is a copolymer obtained by copolymerizing 20 parts of 2-ethylhexylacrylate and 80 parts of styrene, and said I-I-I component is nylon 6. The fibers were passed through a card and a cross lapper to form a web. The average thickness of the I-I-I fibers was about 0.0003 denier. The web was then needle-punched at a density of 2,000 needles/cm$^2$ using needles, each having one barb, so as to entangle the specific island-in-a-sea type fibers with one another and to produce a non-woven fabric. The resulting non-woven fabric had a weight of about 540 g/m$^2$ and of an apparent density of 0.18 g/cm$^3$.

The resulting non-woven fabric was then impregnated with a 10% aqueous dispersion of polyethylene glycol (molecular weight 200) monolaurate and was subsequently dried so as to plasticize the sea component. A large number of columnar streams of water pressurized to 105 kg/m$^2$ were jetted once to each surface of the sheet using a nozzle which has a line of apertures of 0.25 mm diameter and 1.5 mm pitch between the center of the appertures, while the nozzle was being oscillated, followed by drying of the sheet. The resultant sheet had a fiber structure in which the islands-in-sea type fibers, branched ultrafine fibers and the branched bundles of ultrafine fibers were densely entangled with one another. Next, the sheet was pressed by a hot roller at 150° C. to smooth the surface treated with the water stream. A 10% solution of polyurethane made from polyethylenebutyleneadipate, diphenylmethane-4-4'-diisocyanate and 1,4-butanediol, to which pigments were added, was applied to the surface by a gravure coater and after the sheet was dried, the leather-like grain pattern was applied to the surface of the sheet using a hot embossing roller at 170° C. The amount of the polyurethane deposited on the surface was about 3 g/m$^2$.

Thereafter, the sheet was repeatedly dipped into trichloroethylene and squeezed to extract and substantially completely remove the vinyl type polymer sea component of the fiber. The sheet was then dried and was dyed with metal-complex dyes using a normal-pressure winch dyeing machine. After a softening agent was applied, the sheet was crumpled and finished.

The resulting leather-like sheet had a weight of 310 g/m$^2$, an apparent density of 0.36 g/cm$^3$, a clear grain pattern and excellent flexibility. The sheet had a composition consisting of 99.0% of fiber and about 1.0% of polyurethane resin by weight. The fiber density coefficient around the surface portion of various thickness from the surface and at around the back surface portion were measured by the described method. The results are set forth in the Table 1.

TABLE 1

| | Fiber Density Coefficient |
|---|---|
| Depth from Surface (microns) | |
| 0–50 | 48.9 |
| 0–30 | 51.3 |
| 0–20 | 48.9 |
| 0–10 | 50.8 |
| Depth from Back Surface | |
| 0–200 | 32.5 |

When the sheet was strongly crumpled by hand, neither scratching nor damage occurred and the sheet was found to have high bending resistance as well as high scratch and scuff resistance. After polyurethane was removed from the grain of the grained sheet, the average distance between the fiber entangling points of the constituent fibers was measured. It was found to be 23 microns. The average distance between the fiber entangling points at the back surface was measured after smoothing with a hot iron. It was found to be 35 microns. The grained sheet had a fiber structure in which the ultrafine fiber bundles and the ultrafine fibers branching from said bundles were entangled with one another.

EXAMPLE 2

Staple fibers, 51 mm long and 4.0 denier, of islands-in-a-sea type fibers (16 islands) and having a composition consisting of 20% of sea and 80% of islands, and further each islands consists of 50% of islands-in-island (I-I-I) and 50% of sea-in-island (S-I-I) were prepared. Said sea and S-I-I component is a copolymer of 95 parts of polystyrene and 5 parts of polyethylene glycol (MW:20,000), and said I-I-I component is nylon 6. The staple fibers were passed through a card and a cross lapper to form a web. The average thickness of the I-I-I was 0.0005 denier. The web was needle-punched at a density of 2.500 needles/cm$^2$ using needles having one barb, to produce needle-punched sheet. The needle-punched sheet had a weight of 540 g/m$^2$ and an apparent density of 0.20 g/cm$^3$.

Water which was pressurized to 100 kg/cm$^2$ was jetted to the surface of the needle-punched sheet while it was being moved, from a nozzle having a line of apertures of a diameter of 0.2 mm and of a pitch of 1.5 mm between the centers of the apertures. The non-woven fabric was treated once while oscillating the nozzle. The resulting non-woven fabric had a fiber structure in which the islands-in-sea type fibers and branched ultrafine fibers and branched bundles of ultrafine fibers were densely entangled with one another.

The non-woven fabrics was then impregnated from the back surface with a 5% dimethylformamide solution of polyurethane prepared by chain-extending a prepolymer between a mixed diol consisting of polyethylene adipatediol and polybutylene adipatediol and diphenylmethane-4-4'-diisocyanate using ethylene glycol. The non-woven fabric was introduced into water and the polyurethane was coagulated. Thereafter, the non-woven fabric was sufficiently washed with hot water at 80° C. to remove the dimethylformamide. After being dried, the non-woven fabric was repeatedly dipped into trichloroethylene and squeezed to extract the sea component (copolymer of polystyrene and polyethylene glycol) of the fibers. After the polymer was substantially removed, the non-woven fabric was dried to evaporate and remove the remaining trichloroethylene. The amount of the polyurethane deposited was 15 parts by weight based on the weight of Nylon 6 fibers.

Next, a solution which was prepared by adding a pigment to a 10% solution of polyurethane, which had the same composition as that used for impregnation but had considerably higher hardness, was applied to the surface of the sheet by use of a gravure coater. The sheet was then dried. The treatment using a gravure coater and the treatment of drying were repeated twice. The amount of the polyurethane deposited was about 3 g/m$^2$. Thereafter, it was passed through a hot embossing roller of 170° C. for pressing to apply a leather-like grain pattern. Thereafter, the sheet was dyed at a normal pressure using a liquor flow dyeing machine and was finished in a customary manner.

The grained sheet obtained had a smooth surface along the grain pattern, had a good touch and had integral hand characteristics such as flexibility and suppleness, and had a weight of 305 g/m$^2$, an apparent density of 0.34 g/cm$^3$. The sheet consisted of about 86% of fibers and about 14% of polyurethane by weight.

The fiber density coefficient around the surface portion at various depth from the surface were measured. The results are set forth in Table 2.

TABLE 2

| Depth from Surface (microns) | Fiber Density Coefficient |
|---|---|
| 0–50 | 51.8 |

TABLE 2-continued

| Depth from Surface (microns) | Fiber Density Coefficient |
|---|---|
| 0–30 | 52.3 |
| 0–20 | 55.2 |
| 0–10 | 43.7 |

The whole profile of the fiber density coefficients versus depth from the surface was shown in FIG. 6(*a*).

The polyurethane and finishing agent applied to the grained sheet were extracted and removed by a solvent and the distance between the fiber entangling points were measured. The average distance between the fiber entangling points was 37 microns. The grained sheet had a fiber structure in which the ultrafine fibers bundles and the ultrafine fibers branching from said bundles were entangled with one another.

EXAMPLE 3

Specific islands-in-sea type fibers consisting of polyethylene terephthalate as the island component and a mixture of polystyrene and polyethylene glycol (molecular weight 20,000) as the sea component (island/sea weight ratio=60/40) and having cross section in which 16 island-in-a-sea type structures, in each of which 8 islands were present in a sea component, were encompassed by one sea component of polystyrene, were spun using an islands-in-sea type fiber spinning die disclosed in Japanese Patent Laid-Open No. 125718/1979. The island/total sea ratio of the fibers was 48/52. The yarns thus obtained were stretched to 2.5 times the original length, crimped and cut to provide 3.8 denier, 51 mm long staple fibers. Each island component was an ultrafine fiber of 0.014 denier. The staple fibers were then passed through the steps of opening, carding, cross lapping and needle punching to provide a non-woven fabric. And then the non-woven fabric was sliced into two sheets each having a weight about 350 g/m$^2$, apparent density of 0.19 g/cm$^3$, and further slightly buffed at the sliced surface. Columnar streams of the water pressurized to 110 kg/cm$^2$ was jetted to the sliced and buffed surface of the non-woven fabric while it was being moved, from a jet nozzle having apertures having a 0.25 mm diameter and arranged in a line with 2.5 mm gaps there between with oscillating of the nozzle. This treatment was repeated three times and the non-woven fabric was then dried. The resulted non-woven fabric had a fiber structure wherein the ultrafine fibers branching from the islands-in-sea type fibers were densely entangled around the surface, and at the inner portion, all of the islands-in-sea type fibers, the branched ultrafine fiber bundles and the branched ultrafine fibers were entangled with one another.

Next, an 3% dimethylformamide solution of a polyester type polyurethane was made to permeate, for impregnation, from the side of the non-woven fabric to which the water stream was not applied. After wet coagulation with water, the non-woven fabric was dried. The resulting sheet was pressed by a hot roller so as to smooth the surface which was subjected to the treatment with the water jet stream. The amount of polyurethane was 5% based on the polyethylene terephthalate fibers by weight. A two-pack type polyurethane solution was then applied to the smoothed surface of the sheet using a gravure coater and the sheet was then dried. The deposition quantity of this two-pack type polyurethane was about 6 g/m$^2$. After curing, the surface of the sheet coated with the two-pack type polyurethane was embossed at 160° C. using an embossing roller having a leather-like grain pattern.

Thereafter, the sheet was treated with trichloroethylene to remove the sea component of the multi-component fibers. Then, a polyurethane type finishing agent containing a pigment was applied to the grain in a quantity of 3 g/m$^2$ using a gravure coater and was then dyed at 120° C. for one hour using a high temperature dyeing machine while crumpling the sheet. The resulting sheet had grain on one surface and had a weight of 240 g/m$^2$, apparent density of 0.25 g/m$^3$. The sheet consisted of about 92% of fiber and about 8% of polyurethane.

The fiber density coefficient around the surface were measured. The results are set forth in Table 3.

TABLE 3

| Depth from Surface (microns) | Fiber Density Coefficient |
|---|---|
| 0–50 | 37.4 |
| 0–30 | 33.0 |

The non-woven fabric, after the treatment with the water jet streams, was examined by a scanning electron microscope, and the surface was found to have a fiber structure in which the fibrillated ultrafine fibers were entangled with one another. The average distance between the fiber entangling points was found to be 110 microns. The resulting grained sheet had a fiber structure in which the ultrafine fibers branching from the ultrafine fiber bundles were densely entangled around the surface and at the inner portion all of the ultrafine fiber bundles and ultrafine fibers were entangled with one another.

The grain of the sheet of the present invention thus obtained had a grain pattern formed by embossing in addition to the crumple pattern due to crumpling of the sheet during dyeing and since they were well mixed, the sheet had good surface appearance. Furthermore, the hand characteristics, such as flexibility and suppleness, were soft and had less repulsive property. Though the sheet was strongly rubbed, no occurrence of surface cracks were observed.

EXAMPLE 4

Islands-in-a-sea type fibers of 4.0 denier, having a composition consisting of 60 parts of a vinyl type polymer, obtained by copolymerizing 20 parts of 2-ethylhexylacrylate and 80 parts of styrene, as the binding component, and 40 parts of Nylon 6 as I-I-I component, and 7 islands in one filament with each island containing therein about 100 of I-I-I, were crimped and were cut to 51 mm staple fibers. The staple fibers were passed through a card and a cross lapper to form a web. The web was then needle punched using needles, each having one hook at a rate of 1500 needles/cm$^2$ so as to entangle the staple fibers with one another to produce a non-woven fabric. The non-woven fabric thus produced had an apparent density of 0.17 g/cm$^3$ and a thickness of about 2.2 mm. A large number of columnar streams of water which was pressurized to 105 kg/cm$^2$ was jetted once to each surface of the sheet using a nozzle having a line of apertures of 0.25 mm diameter and 2.5 mm pitch between the center of the appertures, while the nozzle was oscillated on the stainless steel conveyer belt.

The resulting sheet had a structure in which part or all of the sea component was broken and the entanglement between the ultrafine fibers or between the ultrafine fibers and the ultrafine fiber bundles bound by the sea component was observed throughout its thickness. Next, the sheet in the wet state was shrunk in a hot water bath of 95° C. and was squeezed with nip rollers to smooth the surface, and dried. Then the sheet was pressed with a hot roller at 150° C. to further smooth the water jetted surface. A 10% solution of polyurethane as used in Example 2 was applied to the surface of the sheet with a gravure coater and dried. The amount of polyurethane deposited was about 3 g/m$^2$.

Then the leather-like grain pattern was applied to the surface of the sheet using a hot embossing roller at 170° C.

Thereafter, the sheet was repeatedly dipped into trichloroethylene and squeezed to extract and substantially completely remove the vinyl type polymer sea component of the fiber. The sheet was then dried and was dyed with metal-complex dyes using a normal-pressure winch dyeing machine. After a softening agent was applied, the sheet was crumpled and finished.

The resulting leather-like sheet had a weight of 170 g/m$^2$, an apparent density of 0.25 g/cm$^3$, a clear grain pattern and excellent flexibility. The sheet had a composition consisting of about 98.2% of the fiber and about 1.8% of the polyurethane resin by weight. The fiber density coefficients of the fibers at various depth from the surface and at the back surface were measuered according to the above described method. The results are set forth in Table 4.

TABLE 4

| | Fiber Density Coefficient |
|---|---|
| Depth from surface (microns) | |
| 0–50 | 41.5 |
| 0–30 | 51.3 |
| 0–20 | 43.2 |
| 0–10 | 49.9 |
| Depth from Back Surface | |
| 0–200 | 16.2 |

The whole profile of the fiber density coefficient of the fibers is shown in FIG. 5(*b*). When the sheet was strongly crumpled by hand, neither scratching nor damage occurred and the sheet was found to have high bending resistance as well as high scratch and scuff resistance. After polyurethane was removed from the grain of the grained sheet, the average distance between the fiber entangling points of the constituent fibers was measured. It was found to be 55 microns. Most of the ultrafine fibers was in the range from 0.001 to 0.04 denier. The average distance between the fiber entalgling points at the back surface was measured as described in Example 1. It was found to be 65 microns. The grained sheet had a structure in which the ultrafine fiber bundles and the ultrafine fibers branching from said bundles were densely entangled with one another.

COMPARATIVE EXAMPLE 1

The same non-woven fabric as used in Example 4 was, without water jetting, impregnated with 18% DMF solution of polyurethane comprising the reaction product between polyethyleneadipate diol, diphenylmethane-4-4'-diisocyanate and ethyleneglycol, and the impregnated polyurethane was coagulated with water. Then the impregnated sheet was washed with trichloroethylene to remove the sea component of the islands-in-sea type fiber, gravure coated with polyurethane as used in Example 4, embossed and dyed in the same way as in Example 4. The amount of polyurethane impregnated and coated were about 65% by weight based on the fiber, and 8 g/m$^2$, respectively. The resulted grained sheet had a repulsive feel, a rubber-like hand characteristics and smooth but excessivly uniform and shallow surface. The graind sheet obtained had a weight of 230 g/m$^2$, an apparent density of 0.35 g/cm$^3$. The sheet consisted of 58% of fiber and 42% of polyurethane resin by weight. The fiber density coefficient around the surface of 50 microns thickness was mesured as 18.1. The polyurethane and the finishing agent applied to the grained sheet were extracted and removed by a solvent and the average distance between the fiber entangling points were measured as 450 microns. That is to say, the grained sheet of this comparative example had not the super-entangled fiber layer.

COMPARATIVE EXAMPLE 2

The non-woven fabric as used in Example 3, was subjected to the water jet treatment in the same way as Example 3. Then it was impregnated throughly with a 5% aqueous solution of polyvinyl alcohol and dried. The amount of polyvinylalcohol impregnated was about 15% based on the weight of poyethylene terephthalate. Next, the sheet was impregnated throughly with 18% polyurethane solution as used in Comparative Example 1, and introduced in water and washed with hot water to coagulate the polyurethane and to remove the polyvinylalcohol. and then dried. The amount of the polyurethane deposited was 58% based on the weight of polyethylene terephthalate fibers. Then the surface of the impregnated sheet was buffed by a buffing paper of 250 mesh and 0.15 mm from the surface was removed. A large number of naps of about 0.2 mm were observed on the surface and the entanglement at the surface was broken. Thereafter, the sheet was subjected to removing the sea component with trichloroethylene, gravure coating repeatedly with polyurethane as used in Example 4, embossing and dyeing in the same way as in Example 3. The amount of coated polyurethane was about 15 g/m$^2$. This grained sheet had a weight of 250 g/m$^2$, an apparent density of 0.35 g/cm$^3$, and a composition consisting of 60% of fiber and 40% of polyurethane by weight. The fiber density coefficient of the fibers at the surface of 50 microns thickness was measured as 16.2. Though we tried to determine the average distance between the fiber entangling points after removing the polyurethane and finishing agent applied to the sheet, the napped surface had too large value of no use. When the sheet was strongly rubbed or pulled by hand, this sheet was easy to crack or fluff. Further, this sheet had a repulsive feel and rubber-like and excessively uniform surface.

The bending resistance, shearing fatigue resistance and scratch and scuff resistance of the grained sheet obtained in Example 1 to 4 and Comparative Examples 1 and 2 were mesured according to the above described methods. The results are set forth in Table 5.

TABLE 5

| | Bending Resistance (class) | Shearing Fatigue Resistance (class) | Scratch and Scuff Resistance (times) |
|---|---|---|---|
| Example | | | |
| 1 | 5 | 5 | 4 |
| 2 | 4 | 5 | 5 |
| 3 | 4 | 4 | 4 |
| 4 | 5 | 5 | 4 |

TABLE 5-continued

| | Bending Resistance (class) | Shearing Fatigue Resistance (class) | Scratch and Scuff Resistance (times) |
|---|---|---|---|
| Comparative Example | | | |
| 1 | 3 | 3 | 2 |
| 2 | 2 | 1 | 1 |

We claim:

1. Artificial grain leather comprising a sheet composed of a resin and a multiplicity of entangled synthetic fibers having a denier of less than about 0.5, said sheet having a body portion and having a grain surface portion wherein the fibers are superentangled at a multiplicity of entangling points, the average distance between the entangling points in said grain surface portion being less than about 200 microns, and the fiber density coefficient, when measured at a surface portion of 30 microns thickness, being greater than about 30.

2. Artificial leather as defined as claim 1, wherein said body portion is essentially free from any resin binder.

3. Artificial leather as defined in claim 1, having a grain surface and a back surface, and wherein the back surface is essentially free of any resin binders.

4. Artificial leather as defined in claim 1, which has a non-porous resin layer on the grain portion of said surface, said resin layer being less than 20 microns thick.

5. Artificial leather as defined in claim 1, wherein the fiber density coefficient is more than 30 when measured at a surface portion of 30 microns thickness.

6. Artificial leather as defined in claim 1, wherein the fiber density coefficient is more than 30 when measured at a surface portion of 20 microns thickness.

7. Artificial leather as defined in claim 1, wherein the fiber density coefficient is more than 30 when measured at a surface portion of 10 micron thickness.

8. Artificial leather as defined in claim 1, wherein said fiber density coefficient is more than 40.

9. Artificial leather as defined in claim 1, wherein said fiber density coefficient is more than 50.

10. Artificial leather as defined in claim 1, wherein said average distance between the entangling points is less than about 150 microns.

11. An artificial leather as defined in claim 1, wherein said distance between the entangling points is less than about 100 microns.

12. An artificial leather having a grained surface and having a back surface, wherein said back surface portion has a superentangled fiber layer having a distance between the entangling points of the fibers of less than about 200 microns.

13. Artificial leather as defined in claim 12, wherein said average distance is less than about about 150 microns.

14. An artificial leather as defined in either of claims 12 and 13, wherein said back surface have a fiber density coefficient of greater than about 10, and a resin density coefficient of less than about 5.

15. Artificial leather as defined in claim 1, wherein the weight ratio of the fibers based on the total weight of said leather is greater than 80%.

16. Artificial leather as defined in claim 1, wherein the weight ratio of the fibers based on the total weight of said leather is greater than 85%.

17. Artificial leather as defined in claim 1, wherein the weight ratio of the fibers based on the total weight of said leather is greater than 90%.

18. Artificial leather as defined in claim 1, wherein the weight ratio of the fibers based on the total weight of said leather is greater than 95%.

19. Artificial leather as defined in claim 1, wherein the weight ratio of the fibers based on the total weight of said leather is greater than 97%.

20. Artificial leather which comprises a fiber sheet, said fiber sheet comprising a multiplicity of ultrafine fibers branching from bundles of ultrafine fine fibers or comprising said ultrafine fibers and said bundles of ultrafine fibers throughout its thickness, said ultrafine fibers and bundles of ultrafine fibers being entangled with one another.

21. Artificial leather as defined in claim 20, wherein a resin is disposed as a non-porous layer on a grain surface of said artificial leather.

* * * * *

UNITED STATES PATENT AND TRADEMARK OFFICE

CERTIFICATE OF CORRECTION

PATENT NO. : 4,612,228

DATED : September 16, 1986

INVENTOR(S) : Hiroyasu Kato and Kenkichi Yagi

It is certified that error appears in the above-identified patent and that said Letters Patent is hereby corrected as shown below:

In the drawings, Sheet 6, Fig. 5(a) should appear as follows:

FIG.5a

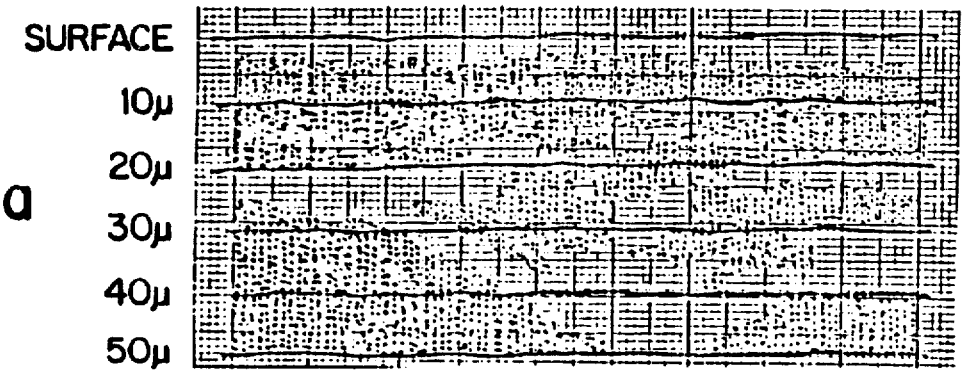

UNITED STATES PATENT AND TRADEMARK OFFICE

CERTIFICATE OF CORRECTION

PATENT NO. : 4,612,228

DATED : September 16, 1986

INVENTOR(S) : Hiroyasu Kato and Kenkichi Yagi

It is certified that error appears in the above-identified patent and that said Letters Patent is hereby corrected as shown below:

In the drawings, Sheet 6, Fig. 5(b) should appear as follows:

FIG. 5b

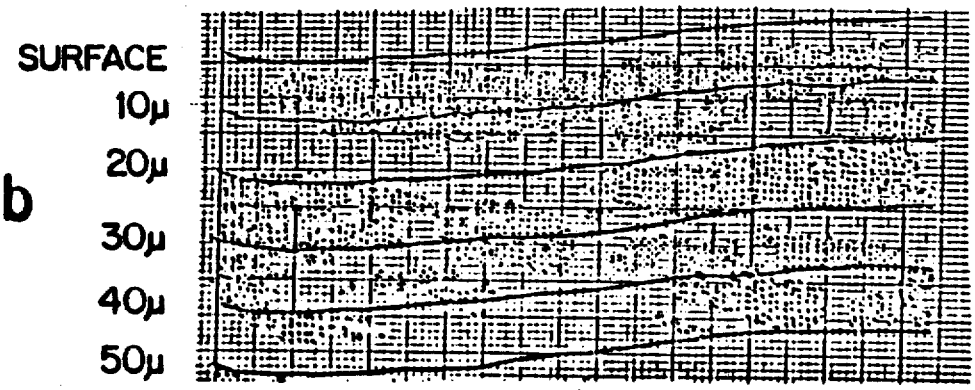

UNITED STATES PATENT AND TRADEMARK OFFICE

CERTIFICATE OF CORRECTION

PATENT NO. : 4,612,228

DATED : September 16, 1986

INVENTOR(S) : Hiroyasu Kato and Kenkichi Yagi

It is certified that error appears in the above-identified patent and that said Letters Patent is hereby corrected as shown below:

In the drawings, Sheet 6, Fig. 5(c) should appear as follows:

FIG. 5c

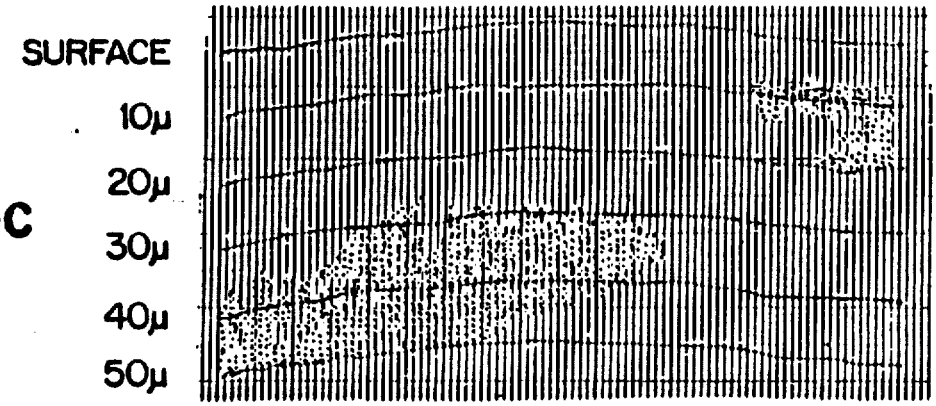

UNITED STATES PATENT AND TRADEMARK OFFICE

CERTIFICATE OF CORRECTION

PATENT NO. : 4,612,228

DATED : September 16, 1986

INVENTOR(S) : Hiroyasu Kato and Kenkichi Yagi

It is certified that error appears in the above-identified patent and that said Letters Patent is hereby corrected as shown below:

In the drawings, Sheet 6, Fig. 5(d) should appear as follows:

FIG. 5d

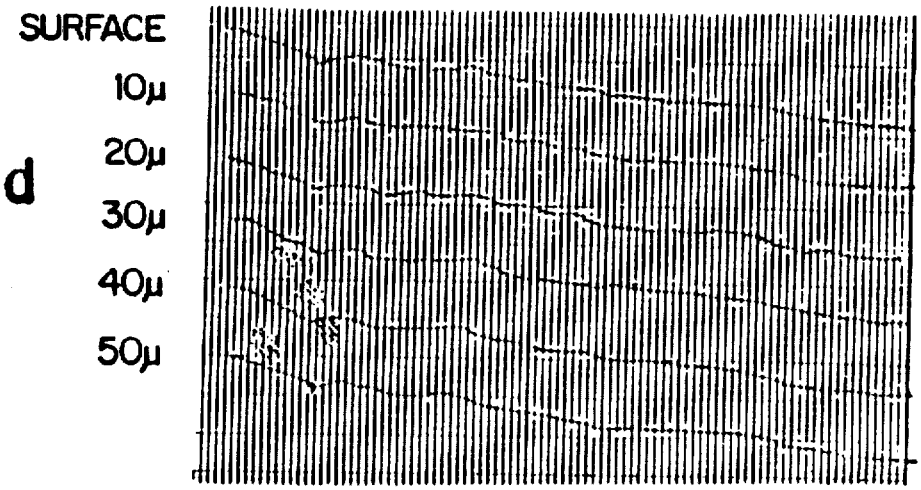

UNITED STATES PATENT AND TRADEMARK OFFICE

CERTIFICATE OF CORRECTION

PATENT NO. : 4,612,228

DATED : September 16, 1986

INVENTOR(S) : Hiroyasu Kato and Kenkichi Yagi

Figure 8A:
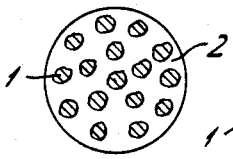
FIGS. 8(*a*) to 8(*o*) are schematic sectional views showing typical examples of fibers which may be used to form the ultrafine fibers employed in the present invention.
Figure 8B:
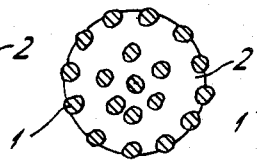
Figure 8C:
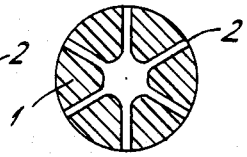
Figure 8D:
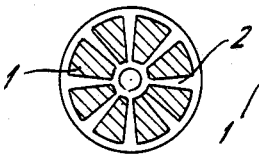
Figure 8E:
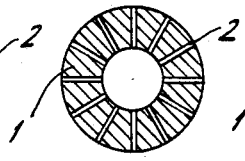
Figure 8F:
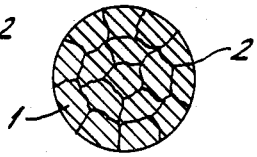
Figure 8G:
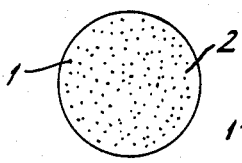
Figure 8H:
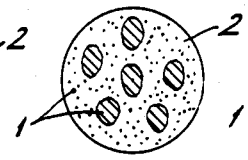
Figure 8I:
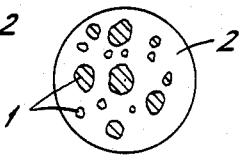
Figure 8J:
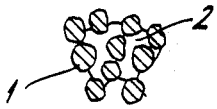
Figure 8K:
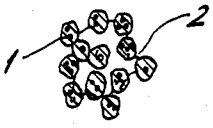
Figure 8L:
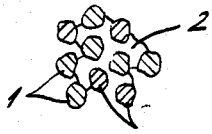
Figure 8M:
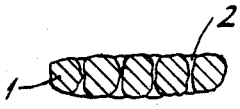
Figure 8N:
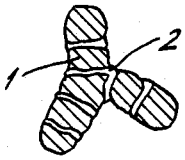
Figure 8O:
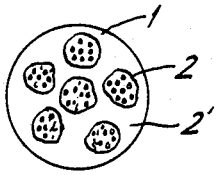
Figure 8P:
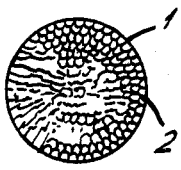
Figure 8Q:
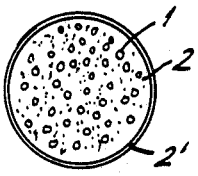
Figure 8R:
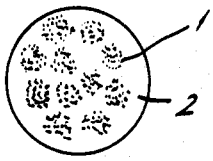

It is certified that error appears in the above-identified patent and that said Letters Patent is hereby corrected as shown below:

In the drawings, Sheet 9, Fig. 8(p) should appear as follows:

FIG. 8(p).

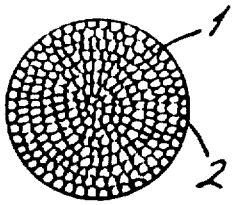

Signed and Sealed this

Seventeenth Day of May, 1988

*Attest:*

*Attesting Officer*

DONALD J. QUIGG

*Commissioner of Patents and Trademarks*